US008395067B2

(12) United States Patent
Marushima et al.

(10) Patent No.: US 8,395,067 B2
(45) **Date of Patent: *Mar. 12, 2013**

(54) SWITCHGEAR AND SWITCHGEAR OPERATING MECHANISM

(75) Inventors: Satoshi Marushima, Kanagawa (JP); Yoshikata Kobayashi, Tokyo (JP); Yoshiaki Ohda, Kanagawa (JP); Masaharu Shimizu, Kanagawa (JP); Tooru Inoue, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 342 days.

This patent is subject to a terminal disclaimer.

(21) Appl. No.: 12/868,416

(22) Filed: Aug. 25, 2010

(65) Prior Publication Data

US 2011/0073446 A1 Mar. 31, 2011

(30) Foreign Application Priority Data

Sep. 29, 2009 (JP) ..... 2009-224786

(51) Int. Cl.
*H01H 5/00* (2006.01)

(52) U.S. Cl. ..... 200/400; 200/318; 218/154

(58) Field of Classification Search ..... 218/7, 14, 218/152–154; 335/8–10, 21, 22, 26–29, 335/167–171, 189–192; 200/400, 401, 500, 200/501, 318, 321–327, 335–337
See application file for complete search history.

(56) References Cited

U.S. PATENT DOCUMENTS

| | | | | |
|---|---|---|---|---|
| 7,772,513 | B2 | 8/2010 | Ohda et al. | |
| 2008/0078666 | A1* | 4/2008 | Ohda et al. | 200/400 |
| 2010/0126967 | A1 | 5/2010 | Ohda et al. | |
| 2011/0000768 | A1 | 1/2011 | Marushima et al. | |

FOREIGN PATENT DOCUMENTS

| | | |
|---|---|---|
| JP | 11-213824 | 8/1999 |
| JP | 2000-40445 | 2/2000 |
| JP | 3497866 | 11/2003 |
| JP | 2007-294363 | 11/2007 |
| JP | 2009-32560 | 2/2009 |
| WO | WO 2009/119080 A1 | 10/2009 |

* cited by examiner

*Primary Examiner* — Amy Cohen Johnson
*Assistant Examiner* — Marina Fishman
(74) *Attorney, Agent, or Firm* — Oblon, Spivak, McClelland, Maier & Neustadt, L.L.P.

(57) ABSTRACT

According to an embodiment, a switchgear operating mechanism has a roller pin rotatably fixed to a leading end of a latch lever. A latch is fixed to a solenoid lever at a position different from the rotation axis of the solenoid lever, and has a leading end engageable with the roller pin. In a state where the switchgear operating state is shifted from the closed state to the cutoff state, the solenoid lever is pushed by an electromagnetic solenoid for cutoff so as to be rotated in an opposite direction to the biasing direction of the solenoid lever return spring, and the latch lever is rotated by a biasing force of the roller pin to release an engagement between the roller pin and the leading end of the latch, which causes a cutoff spring to discharge its energy to rotate the latch lever.

11 Claims, 10 Drawing Sheets

SWITCHGEAR AND SWITCHGEAR OPERATING MECHANISM

CROSS REFERENCES TO RELATED APPLICATIONS

This application is based upon and claims the benefits of priority from the prior Japanese Patent Applications No. 2009-224786, filed in the Japanese Patent Office on Sep. 29, 2009, the entire content of which is incorporated herein by reference.

FIELD

Embodiments described here relate to a switchgear for opening/closing an electrical circuit and its operating mechanism and, more particularly, to a switchgear and its operating mechanism suitably configured for cutting off high-voltage current in short time periods.

BACKGROUND

In general, there are available, as an operating mechanism of a switchgear, one using a hydraulic operating force for large power and one using a spring operating force for middle/small output power. The former is referred to as "hydraulic operating mechanism" and the latter as "spring operating mechanism". In recent years, the advancement of size reduction of an arc-extinguishing chamber of a gas-insulated circuit breaker which is a type of a switchgear allows fault current to be cut off with a smaller operating force, so that application of the spring operating mechanism becomes popular. However, a gas-insulated circuit breaker of extra high-voltage class requires high-speed operating capability called "2-cycle operation" that is capability of achieving cutoff within a time length corresponding to two-cycle time periods of alternating current. A conventional spring operating mechanism typically has operating capability equivalent to about 3-cycle operation, and it is not easy to realize the two-cycle cutoff capability due to poor responsiveness of a retention mechanism or retention control mechanism of a spring force.

A first type of conventional example of an operating mechanism of such a switchgear is disclosed in Japanese Patent Application Laid-Open Publication No. 2007-294363, the entire content of which is incorporated herein by reference. In operation mechanisms disclosed in this document, a force of a cutoff spring is retained by a retention mechanism constituted by a latch, O-prop (opening-hook lever), and a catch through an output lever. In this configuration, when a trip current is applied to a solenoid serving as a retention control mechanism, a plunger of the solenoid activates the catch to allow the engagement between the catch and prop to be released, which releases the engagement between the output lever and the latch to rotate the output lever to release the cutoff spring force, thereby achieving cutoff operation.

A second type of conventional example of the switchgear operating mechanism is disclosed in Japanese Patent No. 3497866, the entire content of which is incorporated herein by reference. In a spring operating mechanism disclosed in this document, a pull-out lever and a retention lever are provided for retaining a cutoff spring force. In this configuration, the retention lever is activated not by the cutoff spring force but by a force of an acceleration spring at the cutoff operation time so as to release the cutoff spring force.

There is known a spring operating mechanism disclosed in Japanese Patent Application Laid-Open Publication No. 2009-32560, the entire content of which is incorporated herein by reference, as a third conventional example of the operating mechanism of a switchgear. In the spring operating mechanism of this reference, a force of a cutoff spring is retained by a retention mechanism constituted by a latch, a ring, and a pull-off link mechanism through an output lever. In this configuration, when a trip current is applied to a solenoid, a plunger of the solenoid activates the pull-off link to allow the engagement between the output lever and the latch to be released, which rotates the output lever to release the cutoff spring force, thereby achieving cutoff operation.

In the first type of conventional example of the switchgear operating mechanism, operation for releasing the cutoff spring force (cutoff operation) is constituted by the following three steps: operation of the catch driven by excitation of the solenoid, operation of the O-prop, and operation of electrical contacts including the cutoff spring. The first type of conventional example is disclosed in the above-referenced Japanese Patent Application Laid-Open Publication No. 2007-294363. The operational relationship between the above components is illustrated in FIG. 15. The horizontal axis denotes time, and vertical axis denotes a stroke of each components. In FIG. 15, the lowermost curve represents the waveform of a trip current and, above this, the stroke of the catch is depicted. Above this, the strokes of the O-prop and the cutoff spring are depicted. The uppermost curve represents an energizing signal of the contact in an arc-extinguishing chamber of a gas-insulated circuit breaker.

Time length from the start of application of the trip current until the operation of the O-prop is started along with the operation of the catch is assumed to be T1. Time length from the start of operation of the O-prop to the start of operation of the cutoff spring is assumed to be T2. Time length from the start of operation of the cutoff spring until the cutoff spring reaches its contact opening point is assumed to be T3. Assuming that contact opening time period is T0, $$T0=T1+T2+T3 \tag{1}$$

is satisfied.

In order to realize 2-cycle operation, it is necessary to reduce contact opening time period T0 to a given value. Thus, in a typical spring operating mechanism, operations of the components from the catch to the cutoff spring, which occur after the trip current application, are not started simultaneously. That is, the catch operates to some degree to release the engagement between itself and the O-prop to thereby allow operation of the O-prop to be started, and the cutoff spring starts operating after the O-prop operates to some degree. Thus, a mechanism that-retains a cutoff spring force operates in a stepwise manner, so that it is necessary to reduce respective time lengths T1, T2, and T3 in order to reduce T0.

However, since the cutoff spring force is determined by the mass of a movable portion of the arc-extinguishing chamber, opening speed, and drive energy, there is a limit to a reduction of T3. With regard to T2, mass reduction of the O-prop and increase in a force (retention force) of retaining the cutoff spring force allow high-speed operation of the O-prop. However, when the retention force is increased, the size of the O-prop needs to be increased for strength, which limits the mass reduction of the O-prop. It follows that there occurs a limit in the improvement in operation speed relying on the increase in the retention force. Further, when the retention force is increased, a large force is applied to the engagement portion between the O-prop and the catch, so that there occurs a need to increase the size of the catch for strength and to provide a solenoid having a large electromagnetic power for activating the catch.

At present, an excitation method using a large-sized condenser is adopted for obtaining a large power of the solenoid. However, the upper limit value for a current value flowing to the solenoid is specified in the standard, so that there is a limit in the improvement in the output power of the solenoid. As described above, it is difficult to reduce the contact opening time period in the conventional spring operating mechanism.

Also in the second type of conventional example (disclosed in Japanese Patent No. 3497866), operation for releasing the cutoff spring force is constituted by the following three steps: operation of a pull-off hook driven by an electromagnet; simultaneous operation of a reset lever, acceleration spring, and a retention lever; and simultaneous operation of a pull-off lever and a cutoff spring. In this example, the direction of a retention force (pressuring force) of the cutoff spring is made substantially coincident with the rotation center of the retention lever, thereby reducing a force required for the operation of the retention lever.

Further, the speed of movement of the retention lever, which is included in the above second step, is made higher by the accelerating spring to thereby reduce the operation time period. However, it is physically difficult to reduce the operation time period of the second step to zero and, therefore, it is difficult to significantly reduce the entire contact opening time period, also in terms of the problems described in the first example.

Further, the direction of a pressuring force to a portion at which the pull-off lever and the retention lever are engaged with each other is made substantially coincident with the rotation center of the retention lever, so that when an external vibration is applied to the retention lever to force the same to vibrate, the pull-off lever is rotated in the cutoff operation direction, and the cutoff operating mechanism may start operating without a cutoff command.

Further, although not described in the above referenced Japanese Patent No. 3497866, it is just conceivable that the retention lever operates in the cutoff direction due to an impact force applied when the roller pushes aside the retention lever for reengagement in the closing operation to allow the cutoff operation to be started without a cutoff command. As described above, in the second example, it is difficult to significantly reduce the contact opening time period and it is likely that a retention state of the cutoff spring becomes unstable.

In the third conventional example (Japanese Patent Application Laid-Open Publication No. 2009-32560), when the solenoid is excited, the cutoff operation is completed by two operation steps: a first operation step in which the latch is directly driven through the pull-off lever and the pull-off link to release an engagement between the latch and the roller pin; and a second operation step in which the cutoff spring operates. With the configuration in which the cutoff operation can be completed by two operation steps, the cutoff operation time period can be reduced. This means that T2 is removed from the expression (1) representing the contact opening time period. However, a torque in the opposite direction to the pull-off direction of the latch is applied to the latch by the cutoff spring force from the time when the latch is driven to the time when the engagement between the latch and the roller pin is released. This prevents significant reduction of the cutoff operation time period.

Further, the latch, the pull-off lever, and the pull-off link move in a unified manner, so that the mass of a movable portion becomes large, preventing high-speed operation.

Further, a connection between the latch and the pull-off link and a connection between the pull-off link and the pull-off lever are made by a pin connection, so that a gap is formed between each of the connections, preventing high-speed response.

Further, the latch is returned to the closed-state position by the biasing force of the latch return spring immediately before completion of the closing operation. At this time, the latch and the pull-off link move in a unified manner to increase the mass of the movable portion. Thus, if the latch return spring force is insufficient, the return of the latch is delayed, which may cause failure in the closing operation. If the latch return spring force is made larger as a countermeasure against the above problem, it requires longer time period to achieve the contact opening.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION

Figure 1:
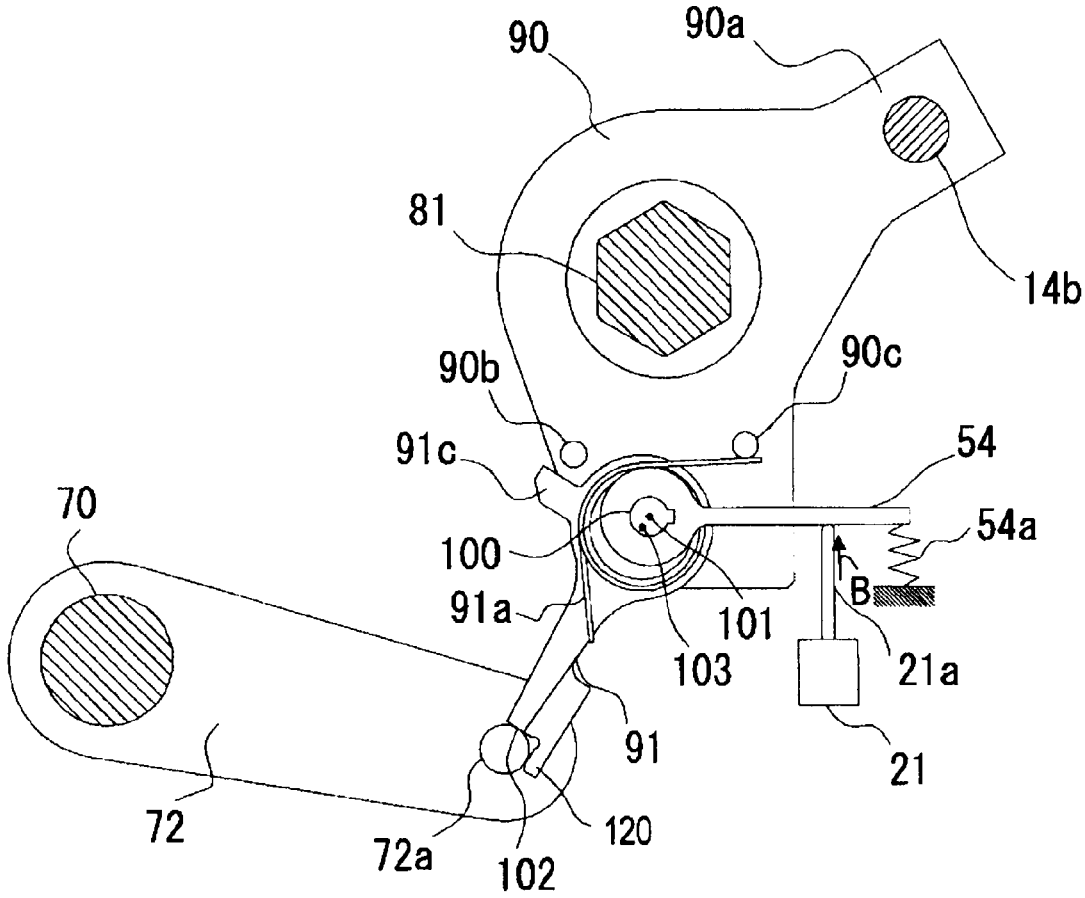
FIG. 1 is a front view illustrating a closed state of a retention unit and a retention control unit of a switchgear operating mechanism according to a first embodiment of the present invention.

The embodiments of the present invention have been made to solve the above-mentioned problems, and an object thereof is to provide a switchgear for opening/closing an electrical circuit and its operating mechanism that retain and release the cutoff spring force by means of a combination of the latch and its malfunction preventing mechanism, reduce the time period until the cutoff spring force is released to significantly reduce the entire contact opening time period, and increase stability or reliability of retention operation of the cutoff spring force.

According to an aspect of the invention, there is provided a switchgear operating mechanism for reciprocatively driving a movable contact of a switchgear so as to shift the switchgear between a cutoff state and a closed state. The operating mechanism has: a frame; a closing shaft rotatably disposed relative to the frame; a main lever which is fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state; a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with a rotation of the closing shaft; a latch lever which is swingably disposed and fixed to the sub-shaft; a roller pin rotatably fixed to a leading end of the latch lever; a solenoid lever provided so as to be rotated relative to the frame around a rotation axis substantially parallel to the rotation axis of the closing shaft; a solenoid lever return spring which biases the solenoid lever so as to rotate the solenoid lever in a predetermined direction; a latch which is fixed to the solenoid lever at a position different from the rotation axis of the solenoid lever so as to be rotated around a rotation axis substantially parallel to the rotation axis of the closing shaft and has a leading end engageable with the roller pin; a latch return spring which biases the latch so as to rotate the latch in a predetermined direction; and an electromagnetic solenoid for cutoff which acts against the biasing force of the solenoid lever return spring to push the solenoid lever so as to shift the switchgear operating state from the closed state to the cutoff state. In a state where the switchgear operating state is shifted from the closed state to the cutoff state, the solenoid lever is pushed by the electromagnetic solenoid for cutoff so as to be rotated in an opposite direction to the biasing direction of the solenoid lever return spring, and the latch lever is rotated by the biasing force of the roller pin to release an engagement between the roller pin and the leading end of the latch, which causes the cutoff spring to discharge its energy to rotate the latch lever.

According to another aspect of the invention, there is provided a switchgear having a movable contact that can be moved in a reciprocating manner and an operating mechanism that drives the movable contact and configured to be shifted between a cutoff state and a closed state by the movement of movable contact. The operating mechanism has: a frame; a closing shaft rotatably disposed relative to the frame; main lever which is fixed to the closing shaft and which can be swung in conjunction with the movable contact; a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft; a sub-lever which is swingably fixed to the sub-shaft; a main-sub connection link which rotatably connects a leading end of the sub-lever and the main lever; a cam mechanism which swings the sub-shaft in accordance with a rotation of the closing shaft; latch lever which is swingably disposed and fixed to the sub-shaft; a roller pin rotatably fixed to a leading end of the latch lever; a solenoid lever provided so as to be rotated relative to the frame around a rotation axis substantially parallel to the rotation axis of the closing shaft; a solenoid lever return spring which biases the solenoid lever so as to rotate the solenoid lever in a predetermined direction; a latch which is fixed to the solenoid lever at a position different from the rotation axis of the solenoid lever so as to be rotated around a rotation axis substantially parallel to the rotation axis of the closing shaft and has a leading end engageable with the roller pin; a latch return spring which biases the latch so as to rotate the latch in a predetermined direction; and an electromagnetic solenoid for cutoff which acts against the biasing force of the solenoid lever return spring to push the solenoid lever so as to shift the switchgear operating state from the closed state to the cutoff state. In a state where the switchgear operating state is shifted from the closed state to the cutoff state, the solenoid lever is pushed by the electromagnetic solenoid for cutoff so as to be rotated in an opposite direction to the biasing direction of the solenoid lever return spring, and the latch lever is rotated by the biasing force of the roller pin to release an engagement between the roller pin and the leading end of the latch, which causes the cutoff spring to discharge its energy to rotate the latch lever.

Embodiments of an operating mechanism of a switchgear according to the present invention will be described below with reference to the accompanying drawings.

[First Embodiment]

Figure 2:
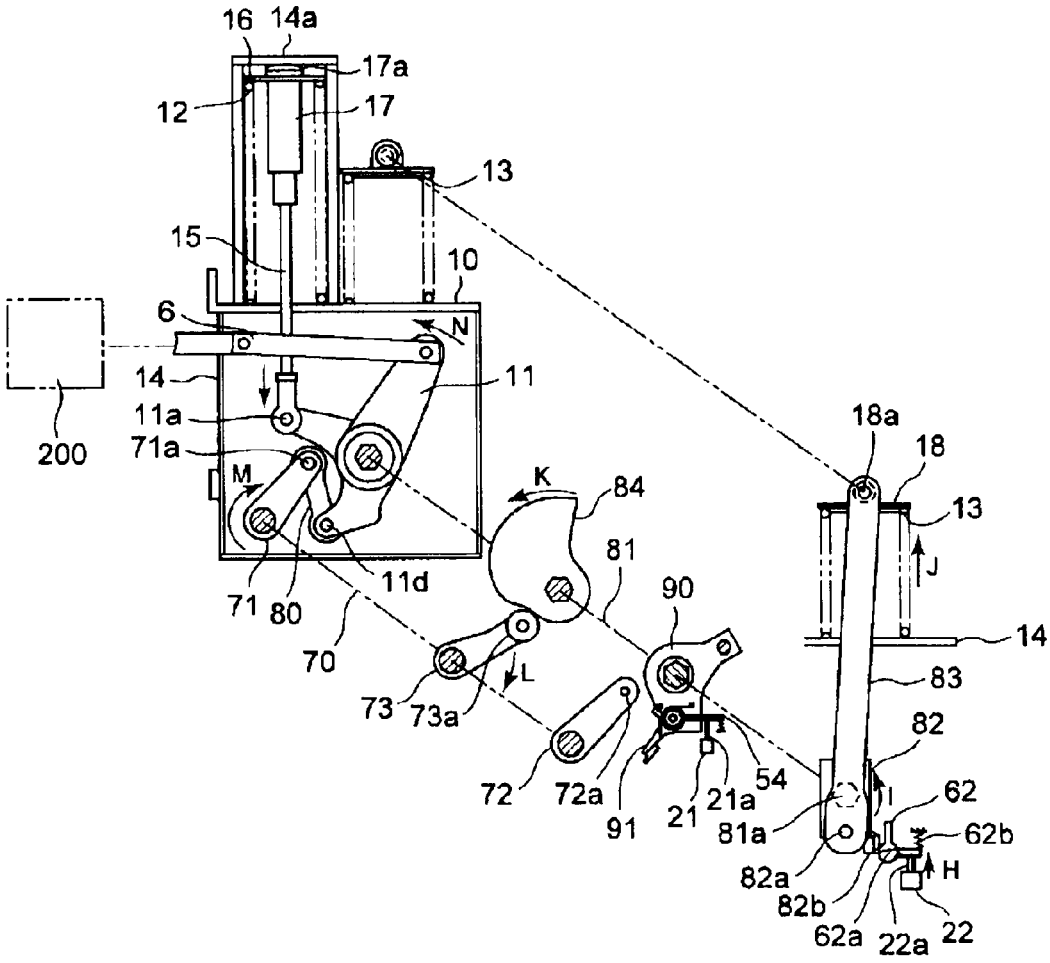
FIG. 2 is a developed front view illustrating a cutoff state of the spring operating mechanism of the switchgear; illustrated in FIG. 1.
Figure 3:
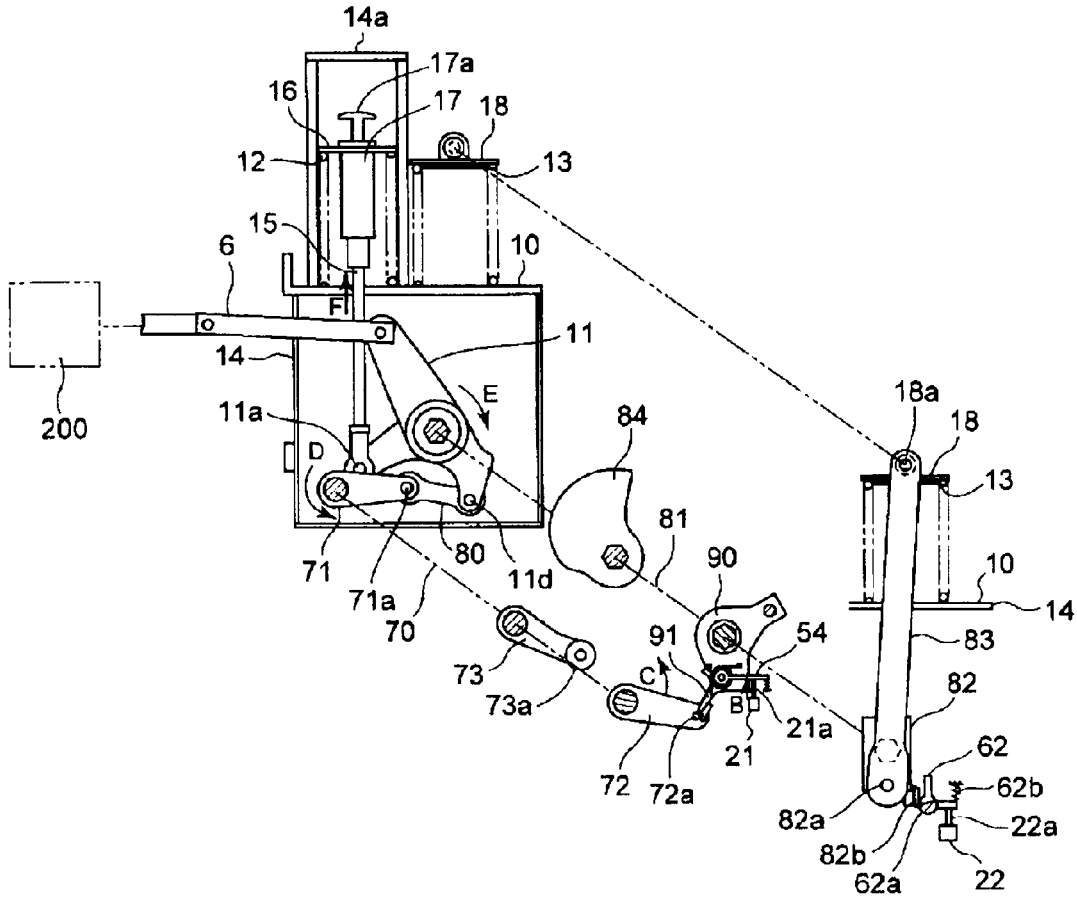
FIG. 3 is a developed front view illustrating a closed state of the spring operating mechanism of the switchgear illustrated in FIG. 1.
Figure 6:
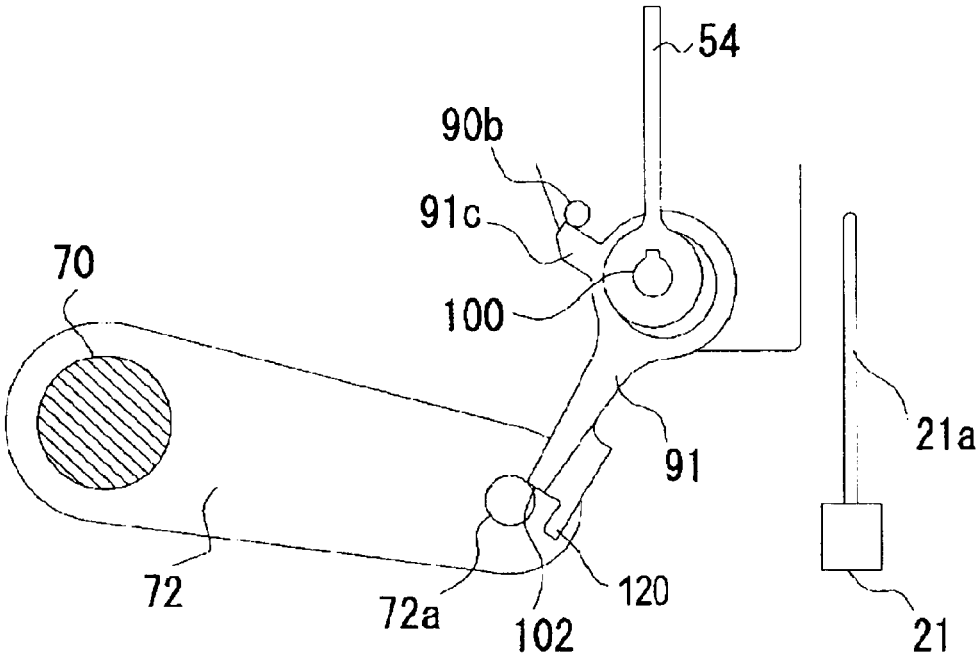
FIG. 6 is a front view of the main part of the switchgear of FIG. 1, which illustrates a cutoff operation process continued from FIG. 5.
Figure 7:
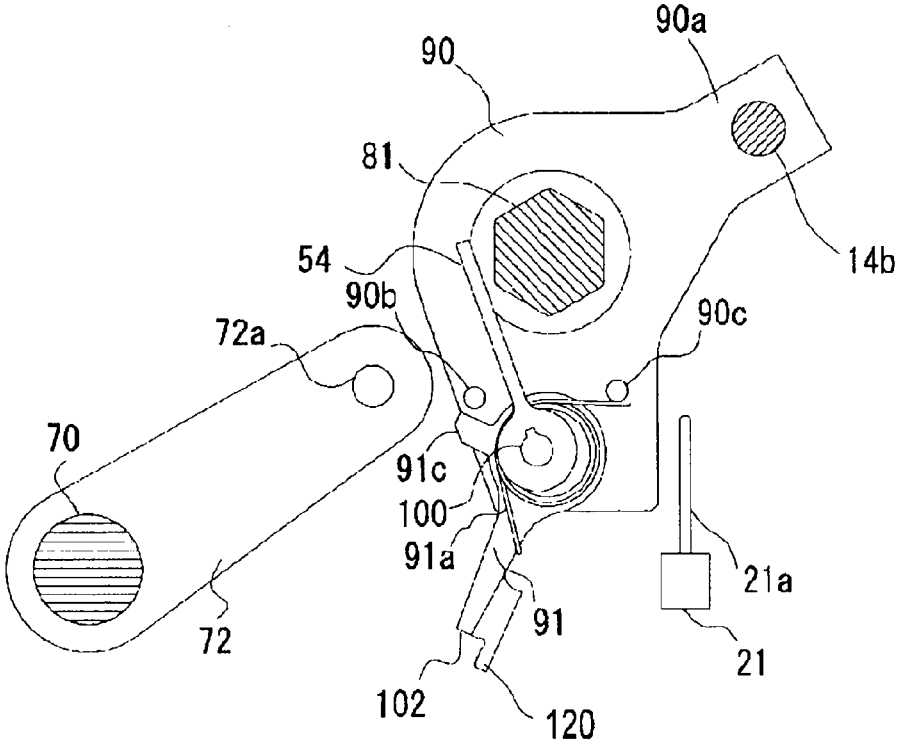
FIG. 7 is a front view of the main part of the switchgear of FIG. 1, which illustrates a cutoff operation process continued from FIG. 6.
Figure 8:
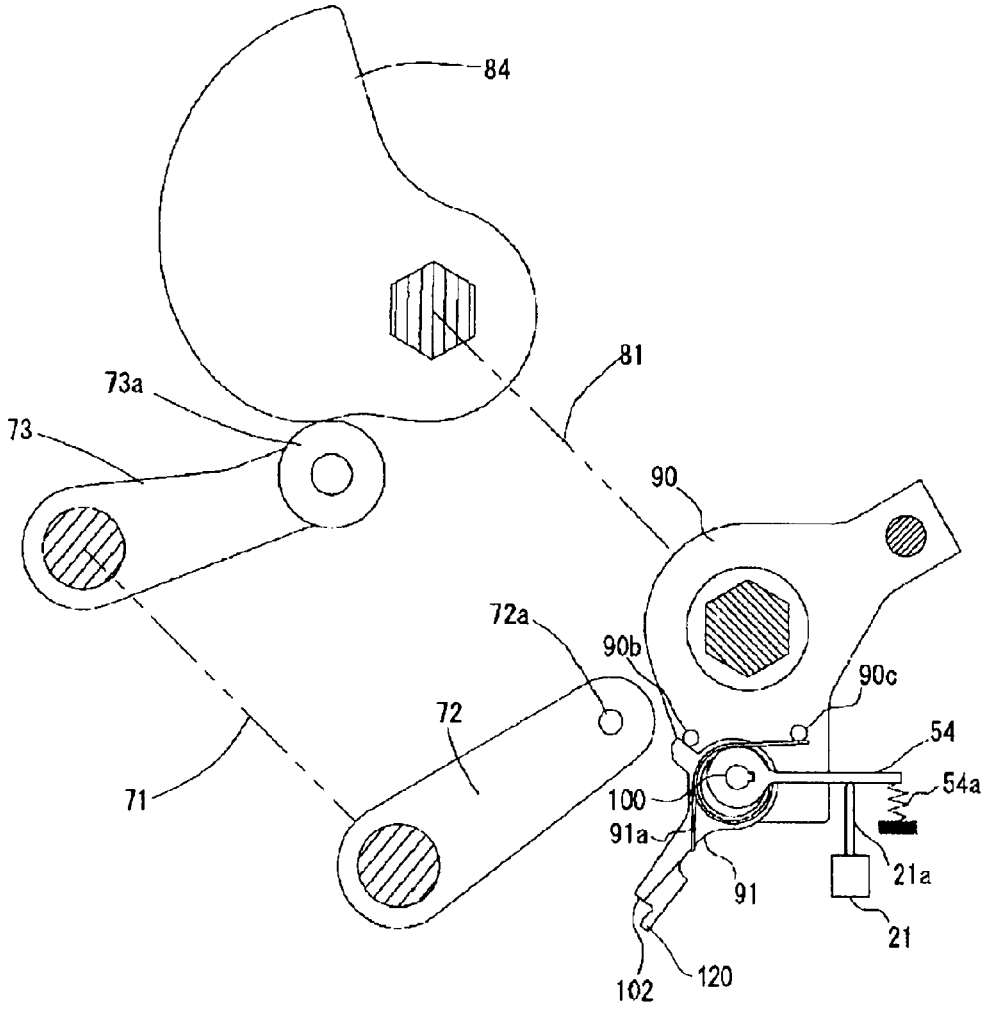
FIG. 8 is a front view of the main part of the switchgear of FIG. 1, which illustrates a closing operation process from the cutoff state to the closed state.
Figure 9:
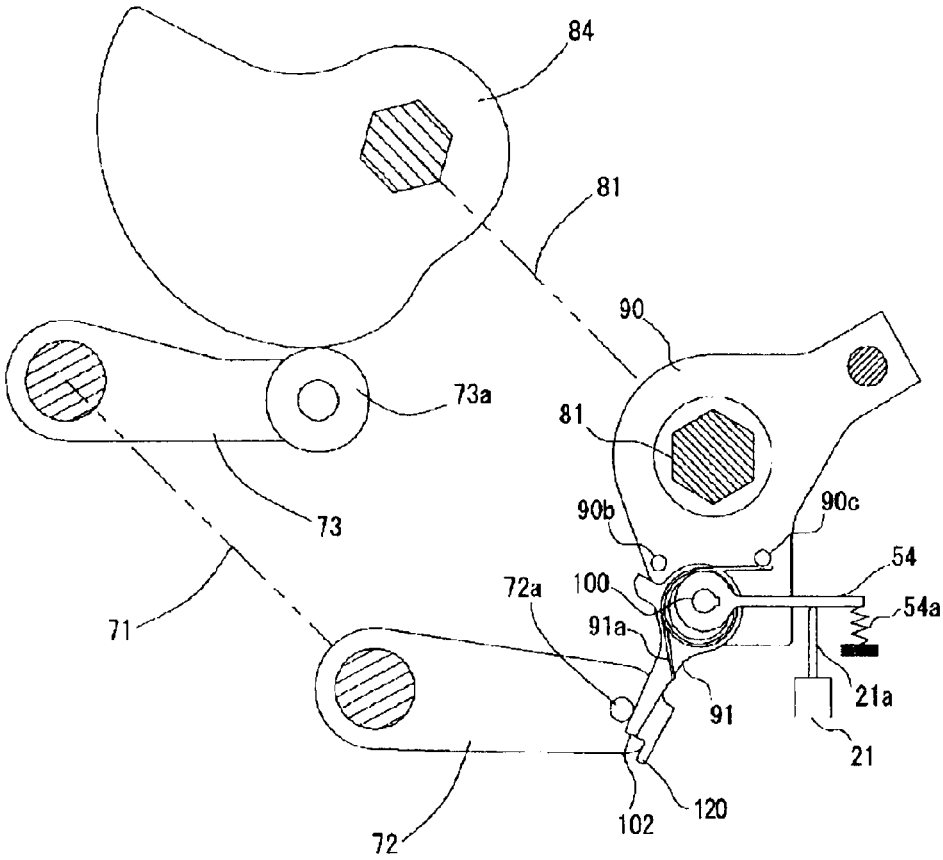
FIG. 9 is a front view of the main part of the switchgear of FIG. 1, which illustrates a closing operation process continued from FIG. 8.

First, with reference to FIGS. 1 to 9, a first embodiment of a switchgear operating mechanism according to the present invention will be described. FIG. 1 is a front view illustrating a closed state of a retention unit and a retention control unit of a switchgear operating mechanism. FIG. 2 is a view illustrating a cutoff state of a spring operating mechanism including the units illustrated in FIG. 1. FIG. 3 is a view illustrating a closed state of a spring operating mechanism including the units illustrated in FIG. 1. FIGS. 4 to 7 are views illustrating a cutoff operation process from the closed state to the cutoff state. FIGS. 8 and 9 are views illustrating a closing operation process from the cutoff state to the closed state.

In FIGS. 2 and 3, a movable contact 200 is connected to the left side of a link mechanism 6. When the link mechanism 6 is moved in the right direction as illustrated in FIG. 2, the movable contact 200 becomes "open" to achieve a cutoff state. On the other hand, when the link mechanism 6 is moved in the left direction as illustrated in FIG. 3, the movable contact 200 becomes "closed" to achieve a closed state. One end of the link mechanism 6 is rotatably engaged with the leading end of a main lever 11, and the main lever 11 is rotatably fixed to a closing shaft 81. The closing shaft 81 is rotatably supported by a bearing (not illustrated) fixed to a frame (support structure) 14.

A cutoff spring 12 has one end fixed to an attachment surface 10 of the frame 14 and the other end fitted to a cutoff spring receiver 16. A damper 17 is fixed to the cutoff spring receiver 16. In the damper 17, a fluid is encapsulated and a piston 17*a* is provided so as to translationally slide. One end of the damper 17 is fixed to a cutoff spring link 15, which is rotatably attached to a pin 11*a* of the main lever 11.

A sub-shaft 70 is rotatably disposed relative to the frame 14, and a sub-lever 71 is fixed to the sub-shaft 70. A pin 71*a* is disposed at the leading end of the sub-lever 71. A pin 11*d* disposed on the main lever 11 and the pin 71*a* are connected by a main-sub connection link 80. A latch lever 72 is fixed to the sub-shaft 70, and a roller 72*a* is rotatably fitted to the leading end of the latch lever 72. Further, a cam lever 73 is fixed to the sub-shaft 70, and a roller 73*a* is rotatably fitted to the leading end of the cam lever 73.

A closing spring 13 has one end fixed to an attachment surface 10*d* of the frame 14 and the other end fixed to a closing spring receiver 18. A pin 18*a* is disposed on the closing spring receiver 18. The pin 18*a* is connected to a pin 82*a* of a closing lever 82 which is fixed to the end portion of the closing shaft 81 through a closing link 83. A closing cam 84 is fixed to the closing shaft 81 and releasably engaged with the roller 73*a* in accordance with the rotation of the closing shaft 81.

A tab 82*b* is disposed at one end of the closing lever 82 and is releasably engaged with a half-column portion 62*a* provided in an anchoring lever 62 for closing which is rotatably disposed relative to the frame 14. Further, a return spring 62*b* is disposed at one end of the anchoring lever 62 for closing. The other end of the return spring 62*b* is fixed to the frame 14. The return spring 62*b* is a compression spring and the spring force thereof always acts on the anchoring lever 62 for closing as a clockwise torque. However, the rotation of the anchoring lever 62 is restricted by an engagement between a plunger 22*a* of an electromagnetic solenoid 22 for closing which is fixed to the frame 14 and the anchoring lever 62 for closing.

In the cutoff state illustrated in FIG. 2, a center 101 of the closing shaft 81 is displaced to the left relative to the center axis (or the axis connecting the centers of the pin 18*a* and the pin 82*a*) of the closing link 83, so that a counterclockwise torque is applied to the closing lever 82 by the closing spring 13. However, the rotation of the closing lever 82 is retained by an engagement between the tab 82*b* and the half-column portion 62*a*.

As shown in FIG. 1, a projecting support portion 90*a* projects from an anchoring lever 90. The support portion 90*a* is engaged with a pin 14*b* fixed to the frame 14, which fixes the position of the anchoring lever 90 relative to the frame 14.

A solenoid lever 54 is fixed to an eccentric pin 100 rotatably disposed at the end portion of the anchoring lever 90. A solenoid lever return spring 54*a* is disposed at one end of the solenoid lever 54, and the other end of the solenoid lever return spring 54*a* is fixed to the frame 14. The solenoid lever return spring 54*a* is a tension spring and the spring force thereof always acts on the solenoid lever 54 as a clockwise torque. However, the rotation of the solenoid lever 54 is restricted by an engagement between a plunger 21*a* of a solenoid 21 for cutoff fixed to the frame 14 and the solenoid lever 54.

A latch 91 is rotatably disposed around the eccentric pin 100 so as to have a rotation axis center 103 at a position eccentric from a rotation axis center 101 of the solenoid lever 54. The latch 91 has a projection portion 91*c*. The latch return spring 91*a* is disposed between the anchoring lever 90 and the latch 91, and the end portion of the latch return spring 91*a* is engaged with a pin 90*c* fixed to the anchoring lever 90. The latch return spring 91*a* always generates a clockwise torque for the latch 91. The clockwise rotation of the latch 91 is restricted by an abutment between a stopper pin 90*b* disposed on the anchoring lever 90 and the projection portion 91*c* of the latch 91. A leading end 102 of the latch 91 is formed by a flat surface perpendicular to a line connecting the leading end 102 and the rotation axis center 103 of the latch 91.

A leading end projection portion 120 projects from one side surface of the leading end 102 of the latch 91. In the closed state shown in FIGS. 1 and 3, at one side of a position at which the latch leading end 102 is engaged with the roller pin 72*a*, the side surface of the leading end projection portion 120 pushes the side surface of the roller pin 72*a* by means of the clockwise torque of the latch return spring 91*a* applied to the latch 91.

The leading end of a plunger 21*a* of the electromagnetic solenoid 21 for cutoff which is fixed to the frame 14 is releasably engaged with the solenoid lever 54, which causes the solenoid lever 54 to be rotated in the counterclockwise direction upon input of a cutoff command.

In the closed state shown in FIGS. 1 and 3, the leading end 102 of the latch 91 is engaged with the roller pin 72*a*, the roller pin 72*a* pushes the leading end 102 toward the rotation axis center 103 of the latch 91, and the rotation of the solenoid lever 54 is restricted by the plunger 21*a* of the electromagnetic solenoid 21 for cutoff. Further, the rotation axis center 103 of the latch 91 is positioned on a line connecting the center of roller pin 72*a* and the rotation axis center 101 of the solenoid lever 54 or displaced slightly from the line toward the sub-shaft 70 side, which restrict the counterclockwise rotation of the latch 91.

In the closed state, the main lever 11 always receives a clockwise torque by an expanding spring force of the cutoff spring 12. The force transmitted to the main lever 11 is then transmitted to the sub-lever 71 through the main-sub connection link 80. The transmitted force becomes a torque for always rotating the sub-lever 71 in the counterclockwise direction. This counterclockwise torque is supplied also to the latch lever 72. However, in the closed state, the leading end 102 of the latch 91 and the roller pin 72*a* are engaged with each other to restrict the counterclockwise rotation of the latch lever 72. Accordingly, the subsequent members from the sub-lever 71 to the cutoff spring 12 maintain their static state.

In the present embodiment, the rotation shafts, such as the closing shaft 81 and the sub-shaft 70, and axes of the respective pins are parallel to each other.

(Cutoff Operation)

In the present embodiment having the configuration described above, a cutoff operation from the closed state shown in FIGS. 1 and 3, through states shown in FIGS. 4 to 7, to the cutoff state shown in FIG. 2 will be described.

First, in the closed state shown in FIGS. 1 and 3, upon input of an external command, the electromagnetic solenoid 21 for cutoff is excited to move the plunger 21*a* in the direction of an arrow B.

Since the solenoid lever 54 is engaged with the plunger 21*a*, it is rotated in the counterclockwise direction. In conjunction with the rotation, the eccentric pin 100 is also rotated in the counterclockwise direction. Then, the latch 91 starts to be swung while the engagement state between the leading end 102 of the latch 91 and the roller pin 72*a* is maintained. This state is shown in FIG. 4.

In this state, the roller pin 72*a* pushes the leading end 102 of the latch 91 toward the rotation axis center 103 of the latch 91 (in the direction of an arrow G), and the rotation axis center 103 of the latch 91 is displaced from the line connecting the center of the roller pin 72*a* and the rotation axis center 101 of the solenoid lever 54 toward the opposite side of the sub-shaft 70, so that a counterclockwise torque is applied to the eccentric pin 100 and the solenoid lever 54.

Figure 4:
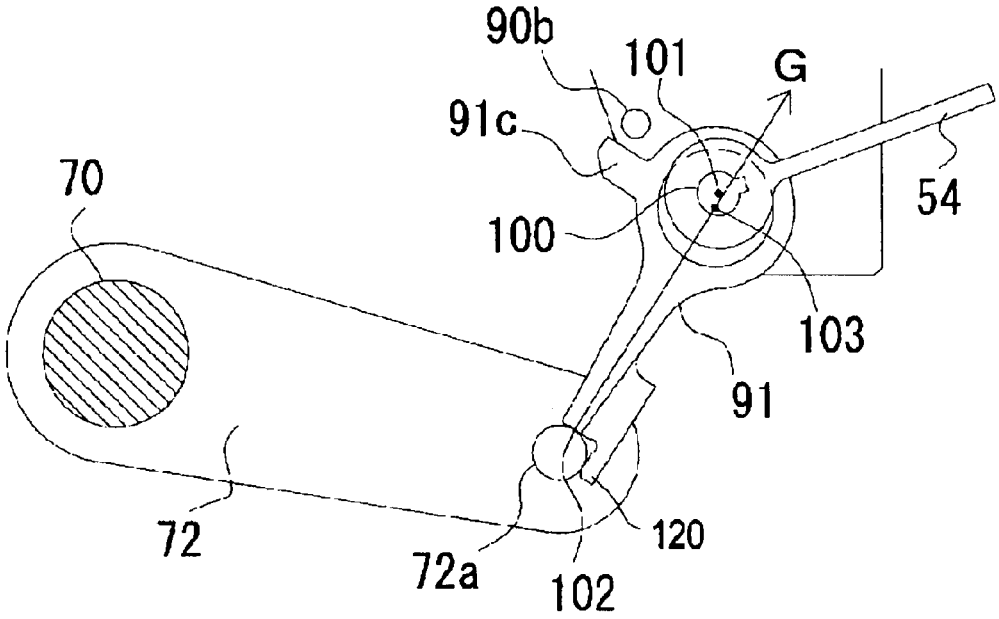
FIG. 4 is a front view of the main part of the switchgear of FIG. 1, which illustrates a cutoff operation process from the closed state to the cutoff state.

After the state shown in FIG. 4, the eccentric pin 100 and the solenoid lever 54 are further rotated in the counterclockwise direction to bring the projection portion 91*c* of the latch 91 into contact with the stopper pin 90*b*. This state is shown in FIG. 5.

Figure 5:
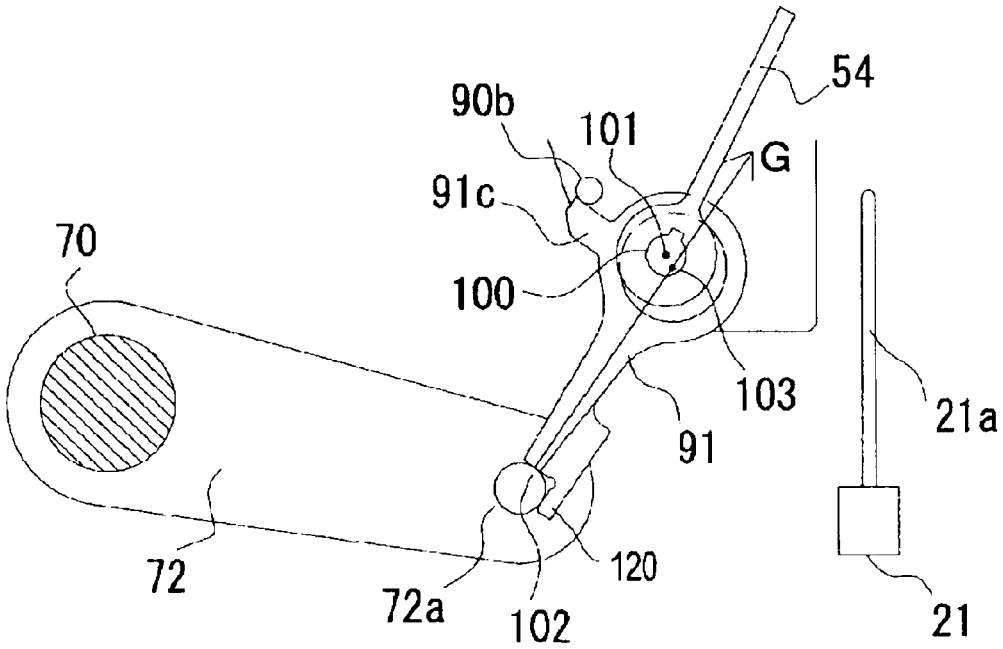
FIG. 5 is a front view of the main part of the switchgear of FIG. 1, which illustrates a cutoff operation process continued from FIG. 4.

After the state shown in FIG. 5, the eccentric pin 100 and the solenoid lever 54 are still further rotated in the counterclockwise direction and, at the same time, the latch 91 is rotated in the counterclockwise direction while contacting the stopper pin 90*b*. This state is shown in FIG. 6. As a result, the engagement between the leading end 102 of the latch 91 and the roller pin 72*a* is released.

In the state shown in FIG. 6, the latch lever 72 receives a counterclockwise torque from the cutoff spring 12, so that it is rotated in the counterclockwise direction while pushing the latch 91. This state is shown in FIG. 7.

FIG. 2 shows the end state of the cutoff operation. In this state, the latch 91 has been returned to substantially the same position as that in the closed state (FIGS. 1 and 3) by the latch return spring 91*a* (FIG. 1). The solenoid lever 54 has also been returned to substantially the same position as that in the closed state (FIGS. 1 and 3) by the solenoid lever return spring 54*a* (FIG. 1).

When an engagement between the latch 91 and the roller pin 72*a* is released in the closed state of FIG. 3, the cam lever 73 and the sub-lever 71, which are fixed to the latch lever 72 and the sub-shaft 70, are rotated in the counterclockwise direction (denoted by arrows C and D). Then, the main lever 11 is rotated in the clockwise direction (denoted by an arrow E) to cause the cutoff spring 12 and the damper 17 to be moved in the direction of an arrow F. Then, the link mechanism 6 and the movable contact 200 connected to the link mechanism 6 are moved to the right to start the cutoff operation.

When the cutoff spring 12 is displaced by a given distance, the piston 17*a* abuts with the stopper 14*a* fixed to the frame 14 to generate a braking power of the damper 17 to thereby stop the movement of the cutoff spring 12. The movements of the link levers connected to the cutoff spring 12 are accordingly stopped, thereby completing the cutoff operation. This state is shown in FIG. 2.

(Closing Operation)

Next, a closing operation from the cutoff state shown in FIG. 2, through a state shown in FIGS. 8 and 9, to the closed state shown in FIGS. 1 and 3 will be described.

FIG. 2 shows a state where the closing spring 13 accumulates energy in the cutoff state. Upon input of an external command, the electromagnetic solenoid 22 for closing is excited to move the plunger 22*a* in the direction of an arrow H. The anchoring lever 62 for closing is engaged with the plunger 22*a*, so that it is rotated in the counterclockwise direction. Then, the engagement between the half-column portion 62*a* and the tab 82*b* is released. Accordingly, the closing lever 82 and the closing shaft 81 are rotated in the counterclockwise direction (denoted by an arrow I) by a spring force of the closing spring 13. The closing spring 13 is stretched in the direction of an arrow J and discharges its accumulated energy. The closing cam 84 fixed to the closing shaft 81 is rotated in the direction of an arrow K to be engaged with the roller 73*a*. When the roller 73*a* is pushed by the closing cam 84, the cam lever 73 is rotated in the clockwise direction (denoted by an arrow L) and, at the same time, the sub-lever 71 is rotated in the direction of an arrow M.

When the rotation of the sub-lever 71 is transmitted to the main lever 11, the main lever 11 is rotated in the counterclockwise direction (denoted by an arrow N). Then, the link mechanism 6 and the movable contact 200 connected to the link mechanism 6 are moved to the left to start the closing operation. The cutoff spring 12 is compressed in association with the rotation of the main lever 11 to accumulate energy to establish an engagement between the roller pin 72*a* and the latch 91 once again, thereby completing the closing operation.

The cam lever 73 is rotated in the clockwise direction in a state where the operation is shifted from the cutoff state shown in FIG. 2 to the closing operation. At the same time, the latch lever 72 fixed to the cam lever 73 and the sub-shaft 70 is rotated in the clockwise direction. This state is shown in FIG. 8.

After the state shown in FIG. 8, the latch 91 is rotated in the counterclockwise direction by the roller pin 72*a*. This state is shown in FIG. 9.

When an engagement between the closing cam 84 and the roller 73*a* is released, the roller pin 72*a* is moved to the position of the closed state by the expanding spring force of the cutoff spring 12. Further, when an engagement between the roller pin 72*a* and the latch 91 is released, the latch 91 is returned to the position of the closed state by the biasing force of the latch return spring 91*a*, and the roller pin 72*a* is engaged with the leading end 102 of the latch 91 once again (FIGS. 1 and 3). In this reengagement state, the roller pin 72*a* pushes the leading end 102 toward the rotation axis center 103 of the latch 91, and the rotation of the solenoid lever 54 is restricted by the plunger 21*a* of the electromagnetic solenoid 21 for cutoff. Further, the rotation axis center 103 of the latch 91 is displaced slightly from the line connecting the center of the roller pin 72*a* and the rotation axis center 101 of the solenoid lever 54 toward the sub-shaft 70 side, which restrict the counterclockwise rotation of the latch 91.

FIGS. 1 and 3 show a state where the closing operation has been completed.

According to the present embodiment, after the electromagnetic solenoid 21 for cutoff is excited upon input of a cutoff command, the cutoff operation is completed by two operation steps: a first operation step in which the latch 91 is directly driven through the solenoid lever 54 to release an engagement between the latch 91 and the roller pin 72*a*; and a second operation step in which the cutoff spring 12 operates. As described above, the number of operation steps for completing the cutoff operation is reduced from three (in the case of conventional spring operating mechanism) to two, thereby significantly reducing the cutoff operation time period. This means that T2 is removed from the expression (1) representing the contact opening time period, so that it is possible to reduce the contact opening time period.

Further, a counterclockwise torque is always applied to the eccentric pin 100 from the time when a cutoff command is input to the time when the engagement between the leading end 102 of the latch 91 and the roller pin 72*a* is released. This allows a further reduction of the contact opening time period.

Further, in this configuration, the latch 91 is not directly driven by the electromagnetic solenoid 21 for cutoff, so that the contact opening time period is less influenced by the latch return spring force. Thus, increasing the spring force of the latch return spring force accelerates the return of the latch at the closing operation time period without increasing the contact opening time period, thereby increasing stability of the closing operation.

Further, the engagement surface of the leading end 102 of the latch 91 is formed by a flat surface, and the roller pin 72*a* pushes the leading end 102 toward the rotation axis center 103 of the latch 91 at the closing operation time, so that a torque of the roller pin 72*a* does not act on the latch 91 in the closed state. This allows a reduction of the size of the latch 91 to thereby minimize a force required for releasing its engagement, which can minimize the size of the electromagnetic solenoid 21 for cutoff.

Further, the switchgear of the present embodiment includes a smaller number of parts than the conventional switchgears, thereby significantly reducing material cost and the number of assembly processes.

[Second Embodiment]

Figure 10:
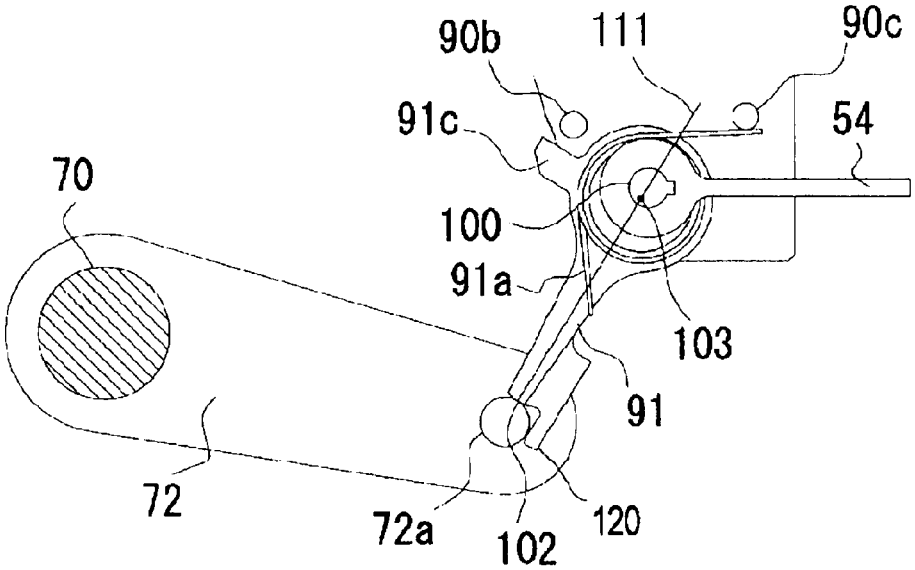
FIG. 10 is a front view illustrating a closed state of a retention unit and a retention control unit of a switchgear operating mechanism according to a second embodiment of the present invention.

FIG. 10 is a front view showing the main portions of the latch and the solenoid lever of the operating mechanism of a switchgear according to a second embodiment of the present invention and their surrounding portion. In FIG. 10, the same reference numerals as those in the first embodiment denote the same or corresponding parts as those in the first embodiment, and the repetitive description is omitted. In the present embodiment, the leading end 102 of the latch 91 is formed by a convex circular arc surface (i.e., convex cylindrical surface), and the center of the circular arc surface substantially on a line 111 connecting the center of the roller pin 72*a* and the rotation axis center 103 of the latch 91 in the closed state. This further reduces a force required for releasing the leading end of the latch 91 from the roller pin 72*a* at the starting phase of the cutoff operation, allowing a reduction of the size of the electromagnetic solenoid and the contact opening time period.

Further, as a modification of the second embodiment, the center of the circular arc surface of the leading end 102 of the latch 91 may be displaced from the line 111 toward the sub-shaft 70 side. This allows stabilization of the closed state.

[Third Embodiment]

Figure 11:
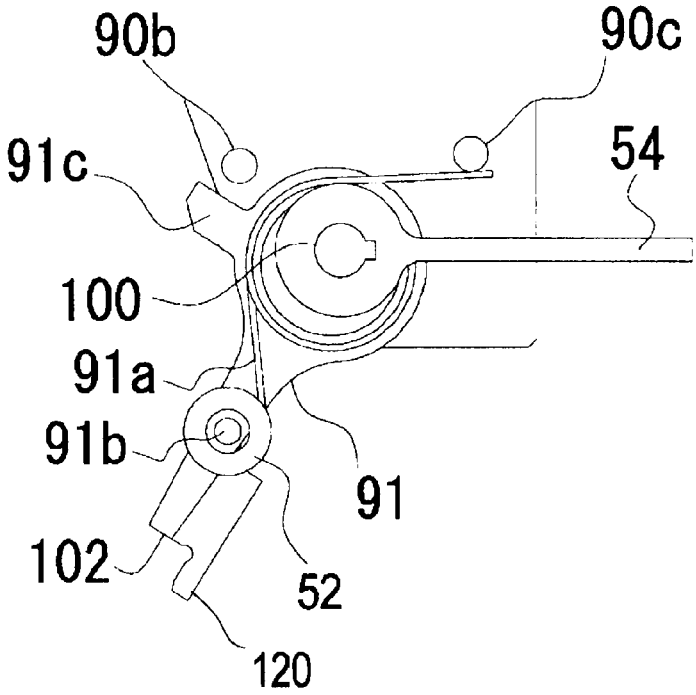
FIG. 11 is a front view illustrating a closed state of a retention unit and a retention control unit of a switchgear operating mechanism according to a third embodiment of the present invention.

FIG. 11 is a front view showing the main portions of the latch and the solenoid lever of the operating mechanism of a switchgear according to a third embodiment of the present invention and their surrounding portion. In FIG. 11, the same reference numerals as those in the first embodiment denote the same or corresponding parts as those in the first embodiment, and the repetitive description is omitted. In the present embodiment, a latch pin 91*b* is disposed on the latch 91, and a ring 52 is disposed on the latch pin 91*b* so as to be movable in the radial direction of the latch pin 91*b*. The inner diameter of the ring 52 is larger than the outer diameter of the latch pin 91*b*.

Figure 12:
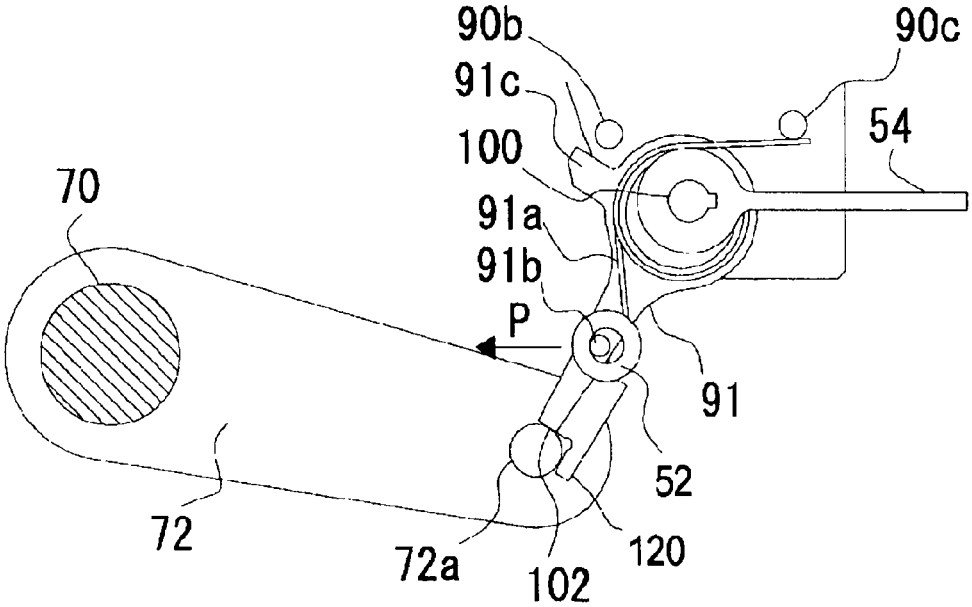
FIG. 12 is a front view of the main part of the switchgear of FIG. 10, which illustrates a closing operation process immediately before the closed state.
Figure 13:
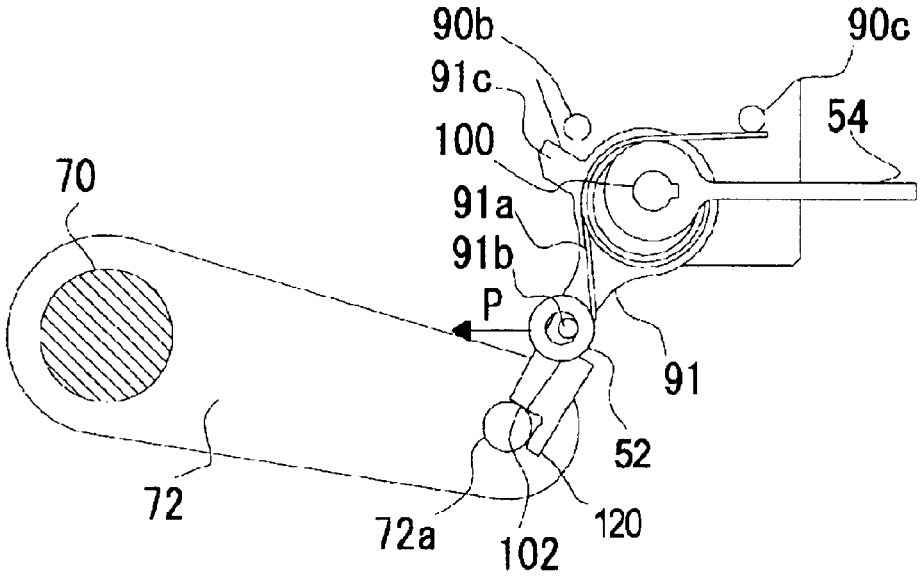
FIG. 13 is a front view of the main part of the switchgear of FIG. 10, which illustrates a closing operation process following the state shown in FIG. 12 immediately before the closed state.

FIGS. 12 and 13 are views showing a state immediately before completion of the closing operation in the thus-configured present embodiment.

At the time when the latch 91 is returned to the closed-state position by the latch return spring 91*a*, the latch 91 collides with the roller pin 72*a* and bounces, so that the latch 91 is not stopped at the closed-state position but is rotated in the counterclockwise direction. This can cause release of the engagement between the leading end 102 of the latch 91 and the roller pin 72*a*, resulting in malfunction.

However, in the present embodiment, when the latch 91 collides with the roller pin 72*a*, the ring 52 is moved by an inertial force in the direction of an arrow P (FIG. 12) which is opposite to the direction in which the latch 91 bounces and collides with the latch pin 91*b* (FIG. 13). This prevents the latch 91 from being rotated in the counterclockwise rotation, thereby preventing malfunction of the latch 91.

According to the present invention, a separation of the latch 91 due to collision between the latch 91 and the roller pin 72*a* during the closing operation can be prevented by means of the ring 52, enabling an increase in reliability of the operation of the spring operating mechanism.

The position of the ring 52 is not limited to that shown in FIG. 11. Even when the ring 52 is disposed at any other position on the latch 91, the same effect can be obtained.

Further, by designing the ring 52 to be formed of metal having high hardness/high density, a high-polymer material having high elasticity, or a complex thereof, it is possible to enhance the effect of preventing a separation of the latch 91.

[Fourth Embodiment]

Figure 14:
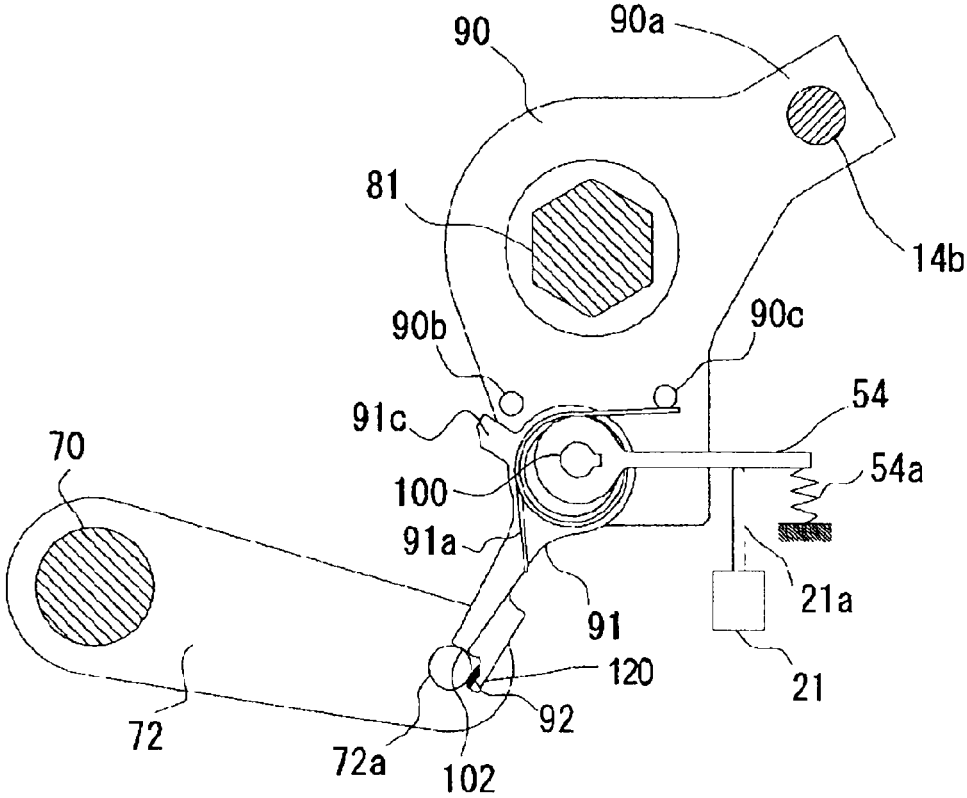
FIG. 14 is a front view illustrating a closed state of a retention unit and a retention control unit of a switchgear operating mechanism according to a third embodiment of the present invention.
Figure 15:
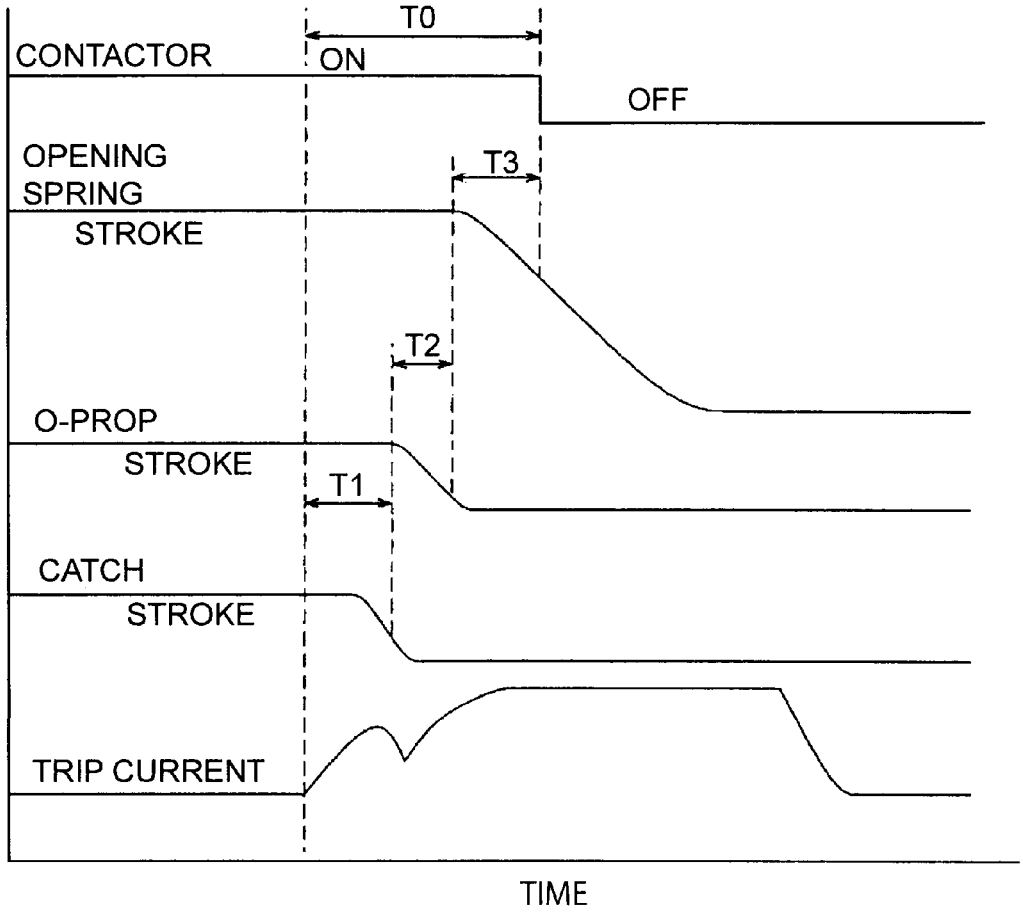
FIG. 15 is a time chart for explaining the cutoff operation of a conventional switchgear.

FIG. 14 is a front view showing the main portions of the latch and the solenoid lever of the operating mechanism of a switchgear according to a fourth embodiment of the present invention and their surrounding portion. In FIG. 14, the same reference numerals as those in the first embodiment denote the same or corresponding parts as those in the first embodiment, and the repetitive description is omitted. In the present embodiment, a vibration absorbing member 92 having high vibration absorption property, such as a high-polymer material, is disposed on the leading end projection portion 120 side of a position at which the leading end projection portion 120 of the latch 91 and the roller pin 72*a* abut each other in the closed state. This alleviates the bounce of the latch 91 due to collision between the latch 91 and the roller pin 72*a*, enhancing the effect of preventing a separation of the latch 91.

[Other Embodiments]

The embodiments described above are merely given as examples, and it should be understood that the present invention is not limited thereto.

For example, although compression coil springs are used as the cutoff spring 12 and the closing spring 13 in the above embodiments, other elastic bodies, such as torsion coil springs, conical springs, spiral springs, leaf springs, air springs, and tension springs may be used alternatively. Further, although coil springs or torsion coil springs are used as the return springs 62*b*, 54*a*, and 91*a* provided in the anchoring lever 62 for closing, the solenoid lever 54, and the latch 91, other elastic bodies such as conical springs, spiral springs, or leaf springs may used alternatively.

The present invention can also be applied to an apparatus having a plurality of cutoff springs or a plurality of closing springs.

Further, since the anchoring lever 90 is fixed to the frame 14, it may be omitted. In this case, the stopper pins 90*b* and 90*c* are directly fixed to the frame 14. Further, the stopper pins 90*b* and 90*c* may be integrated with the anchoring lever 90 or the frame 14.

Further, although the plunger 21*a* of the solenoid 21 for cut-off is used to restrict the clockwise rotation of the solenoid lever 54 caused by the solenoid lever return spring 54*a*, a predetermined pin provided in the frame 14 or the anchoring lever 90 may be used alternatively.

Further, it is possible to provide a plurality of the rings 52 of the third embodiment. In this case, by making the inner diameters and outer diameters of the rings 52 differ from one another, the rings 52 collide with the latch pin 91*b* with time lags, thereby enhancing the effect of preventing a separation of the latch 91. Further, by making the masses of the respective rings 52 differ from one another, the rings 52 collide with the latch pin 91*b* with time lags, thereby enhancing the effect of preventing a separation of the latch 91.

Although the ring 52 of the third embodiment has a hollow doughnut-like shape, the shape of the ring 52 is not limited to this shape, but the same effect can be obtained even with a shape other than the hollow doughnut-like shape.

Although the latch pin 91*b* and the ring 52 are provided in the latch 91 of the first embodiment in the third embodiment, the latch pin 91*b* and the ring 52 may be provided in the latch 91 of the second or fourth embodiment.

Further, although the vibration absorbing member 92 is attached to the latch 91 of the first embodiment in the fourth embodiment, the vibration absorbing member 92 may be attached to the latch 91 of the second or third embodiment.

According to the embodiments described above, in a switchgear for opening/closing an electric circuit and its operating mechanism, retention and release of a cutoff spring force is performed by a combination of a latch and its lock mechanism. With this configuration, it is possible to reduce the time period required for releasing the cutoff spring force to thereby reduce the entire contact opening time period. At the same time, stability and reliability of a retention state of the cutoff spring force can be improved.

What is claimed is:

1. A switchgear operating mechanism for reciprocatively driving a movable contact of a switchgear so as to shift the switchgear between a cutoff state and a closed state, the operating mechanism comprising:

a frame;

a closing shaft rotatably disposed relative to the frame;

a main lever which is fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably disposed and fixed to the sub-shaft;

a roller pin rotatably fixed to a leading end of the latch lever;

a solenoid lever provided so as to be rotated relative to the frame around a rotation axis which is fixed to the frame and extends substantially parallel to the rotation axis of the closing shaft;

a solenoid lever return spring which biases the solenoid lever so as to rotate the solenoid lever in a predetermined direction;

a latch which is fixed to the solenoid lever at a position different from the rotation axis of the solenoid lever so as to be rotated around a rotation axis substantially parallel to the rotation axis of the closing shaft and has a leading end engageable with the roller pin;

a latch return spring which biases the latch so as to rotate the latch in a predetermined direction; and an electromagnetic solenoid for cutoff which acts against the biasing force of the solenoid lever return spring to push the solenoid lever so as to shift the switchgear operating state from the closed state to the cutoff state, wherein in a state where the switchgear operating state is shifted from the closed state to the cutoff state, the solenoid lever is pushed by the electromagnetic solenoid for cutoff so as to be rotated in an opposite direction to the biasing direction of the solenoid lever return spring, and the latch lever is rotated by the biasing force of the roller pin to release an engagement between the roller pin and the leading end of the latch, which causes the cutoff spring to discharge its energy to rotate the latch lever.

2. The switchgear operating mechanism according to claim 1, further comprising an eccentric pin which is fixed to the solenoid lever at the rotation center portion of the solenoid lever so as to be rotatably supported relative to the frame and which supports the latch so as to allow the latch to rotate around a rotation center different from the rotation center of the solenoid lever.

3. The switchgear operating mechanism according to claim 1, wherein the leading end of the latch engage able with the roller pin has a flat surface perpendicular to a line connecting the rotation axis center of the latch and the leading end of the latch.

4. The switchgear operating mechanism according to claim 1, wherein the leading end of the latch engageable with the roller pin has a convex circular arc surface having its center on a line connecting the rotation axis center of the latch and the leading end of the latch.

5. The switchgear operating mechanism according to claim 1, further comprising:

a latch pin which is fixed to the latch; and a ring which has an inner diameter larger than an outer diameter of the latch pin and is disposed surrounding the outer periphery of the latch pin in a radial direction so as to be movable in the radial direction of the latch pin.

6. The switchgear operating mechanism according to claim 1, wherein a leading end projection portion is formed such that it projects from the leading end of the latch and which can contact the roller pin at one side of a position at which the leading end of the latch is engaged with the roller pin before and after the closed state.

7. The switchgear operating mechanism according to claim 6, wherein a vibration absorbing member which absorbs the vibration generated when the roller pin and the leading end projection portion contact each other immediately before the switchgear operating state is shifted to the closed state is attached to the leading end projection portion.

8. The switchgear operating mechanism according to claim 1, comprising:

a closing lever which is fixed to the closing shaft;

a closing link which is rotatably connected to the closing lever; and a closing spring which is disposed between the leading end of the closing link and the frame so as to bias the leading end of the closing link in a direction away from the closing shaft.

9. The switchgear operating mechanism according to claim 8, wherein the closing spring is disposed such that it accumulates energy in the closed state or cutoff state in accordance with the rotation of the closing shaft while it discharges its accumulated energy when the switchgear operating state is shifted from the cutoff state to the closed state.

10. The switchgear operating mechanism according to claim 8, further comprising:

a tab disposed at the leading end of the closing lever; and a retention unit engaged with the tab, wherein the retention unit has;

anchoring lever for closing having a half-column portion;

a return spring for biasing the anchoring lever for closing in a predetermined direction; and an electromagnetic solenoid for closing which drives the retention unit against the biasing force of the return spring to move the anchoring lever for closing so as to shift the switchgear operating state from the cutoff state to the closed state.

11. A switchgear having a movable contact that can be moved in a reciprocating manner and an operating mechanism that drives the movable contact and configured to be shifted between a cutoff state and a closed state by the movement of movable contact, the operating mechanism comprising:

a frame;

a closing shaft rotatably disposed relative to the frame;

a main lever which is fixed to the closing shaft and which can be swung in conjunction with the movable contact;

a cutoff spring which is disposed such that it accumulates energy when the switchgear operating state is shifted from the cutoff state to the closed state in accordance with rotation of the closing shaft while it discharges its accumulated energy when the switchgear operating state is shifted from the closed state to the cutoff state;

a sub-shaft which is rotatably disposed relative to the frame so as to be positioned around a rotation axis substantially parallel to a rotation axis of the closing shaft;

a sub-lever which is swingably fixed to the sub-shaft;

a main-sub connection link which rotatably connects a leading end of the sub-lever and the main lever;

a cam mechanism which swings the sub-shaft in accordance with a rotation of the closing shaft;

a latch lever which is swingably disposed and fixed to the sub-shaft;

a roller pin rotatably fixed to a leading end of the latch lever;

a solenoid lever provided so as to be rotated relative to the frame around a rotation axis which is fixed to the frame and extends substantially parallel to the rotation axis of the closing shaft;

a solenoid lever return spring which biases the solenoid lever so as to rotate the solenoid lever in a predetermined direction;

a latch which is fixed to the solenoid lever at a position different from the rotation axis of the solenoid lever so as to be rotated around a rotation axis substantially parallel to the rotation axis of the closing shaft and has a leading end engageable with the roller pin;

a latch return spring which biases the latch so as to rotate the latch in a predetermined direction; and an electromagnetic solenoid for cutoff which acts against the biasing force of the solenoid lever return spring to push the solenoid lever so as to shift the switchgear operating state from the closed state to the cutoff state, wherein in a state where the switchgear operating state is shifted from the closed state to the cutoff state, the solenoid lever is pushed by the electromagnetic solenoid for cutoff so as to be rotated in an opposite direction to the biasing direction of the solenoid lever return spring, and the latch lever is rotated by the biasing force of the roller pin to release an engagement between the roller pin and the leading end of the latch, which causes the cutoff spring to discharge its energy to rotate the latch lever.

* * * * *